US008991817B1

(12) United States Patent
Terao et al.

(10) Patent No.: US 8,991,817 B1
(45) Date of Patent: Mar. 31, 2015

(54) PAPER CONVEYANCE APPARATUS

(71) Applicants: Kabushiki Kaisha Toshiba, Tokyo (JP); Toshiba Tec Kabushiki Kaisha, Tokyo (JP)

(72) Inventors: Yasunobu Terao, Shizuoka-ken (JP); Shoichi Dobashi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/181,437

(22) Filed: Feb. 14, 2014

(51) Int. Cl.
*B65H 29/70* (2006.01)

(52) U.S. Cl.
CPC ..... *B65H 29/70* (2013.01)
USPC ..... 271/188; 271/209

(58) Field of Classification Search
CPC . B65H 29/70; B65H 31/20; B65H 2301/5122
USPC ..... 271/188, 209, 223
See application file for complete search history.

(56) References Cited

U.S. PATENT DOCUMENTS

| | | | | |
|---|---|---|---|---|
| 7,748,703 | B2 * | 7/2010 | Schererz et al. | 271/188 |
| 7,992,863 | B2 * | 8/2011 | Jacobs et al. | 271/188 |
| 2006/0066035 | A1 | 3/2006 | Terao et al. | |
| 2013/0049280 | A1 | 2/2013 | Soga et al. | |

FOREIGN PATENT DOCUMENTS

| | | |
|---|---|---|
| JP | 2008-156114 | 7/2008 |
| JP | 2008-308251 | 12/2008 |

* cited by examiner

*Primary Examiner* — Michael McCullough
(74) *Attorney, Agent, or Firm* — Patterson & Sheridan LLP

(57) ABSTRACT

A paper conveyance apparatus includes a roller pair including a drive roller and a driven roller configured to discharge a paper from a main body of an image forming apparatus. The paper conveyance apparatus further includes a corrugation component configured to abut against the paper discharged by the roller pair to corrugate the paper as the paper is discharged, and an elastic component configured to push the corrugation component against the discharged paper.

14 Claims, 9 Drawing Sheets

FIG.7A
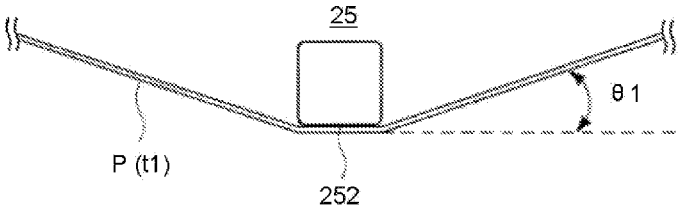
FIG.7B
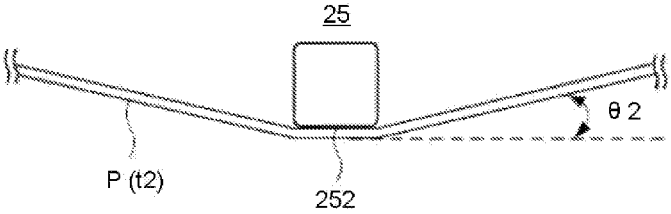
FIG.8
| CORRUGATION COMPONENT | CONVEYING LOAD: gf (GRAM-FORCE) | | | | | |
|---|---|---|---|---|---|---|
| | 1 | 2 | 3 | 4 | 5 | AVERAGE VALUE |
| CONVENTIONAL COMPONENT | 175 | 160 | 175 | 170 | 160 | 168 |
| PRESENT COMPONENT | 110 | 115 | 115 | 115 | 120 | 115 |

| WIDTH OF STANDBY TRAY | CORRUGATION COMPONENT | RESIDUAL CONVEYANCE FORCE: gf (GRAM-FORCE) | | | | | |
|---|---|---|---|---|---|---|---|
| | | 1 | 2 | 3 | 4 | 5 | AVERAGE VALUE |
| 165.0mm | CONVENTIONAL COMPONENT | 35 | 25 | 35 | 25 | 40 | 32 |
| | PRESENT COMPONENT | 100 | 115 | 105 | 105 | 115 | 108 |
| | NO CORRUGATION COMPONENT | 500 | 500 | 500 | 500 | 500 | 500 |
| 177.4mm | CONVENTIONAL COMPONENT | 155 | 160 | 160 | 160 | 160 | 159 |
| | PRESENT COMPONENT | 210 | 210 | 220 | 235 | 225 | 220 |
| | NO CORRUGATION COMPONENT | 500 | 500 | 500 | 500 | 500 | 500 |

PAPER CONVEYANCE APPARATUS

FIELD

Embodiments described herein relate to a paper conveyance apparatus which corrugates a paper corresponding to the thickness of the paper and conveys the paper.

BACKGROUND

Conventionally, the position or intensity of the corrugations added in a direction orthogonal to the conveyance direction of a paper conveyance surface, i.e., a paper width direction, is changed to prevent the front end of a paper from hanging down.

However, a mechanical control needs to be carried out based on a sensor for detecting the width of a paper, a sensor for detecting the thickness of a paper and the detection results of the sensors. Consequently, more components are needed to carry out corrugating processing, which leads to an increase in cost.

BRIEF DESCRIPTION OF THE DRAWINGS

FIG. 7A is a diagram illustrating an effect of FIG. 5;

FIG. 7B is a diagram illustrating an effect of FIG. 6;

FIG. 8 is a diagram illustrating an effect of the first embodiment;

DETAILED DESCRIPTION

A paper conveyance apparatus according to an embodiment includes a roller pair including a drive roller and a driven roller configured to discharge a paper from a main body of an image forming apparatus. The paper conveyance apparatus further includes a corrugation component configured to abut against the paper discharged by the roller pair to corrugate the paper as the paper is discharged, and an elastic component configured to push the corrugation component against the discharged paper.

Embodiments of the present invention are described in detail below with reference to accompanying drawings.

A First Embodiment

Figure 1:
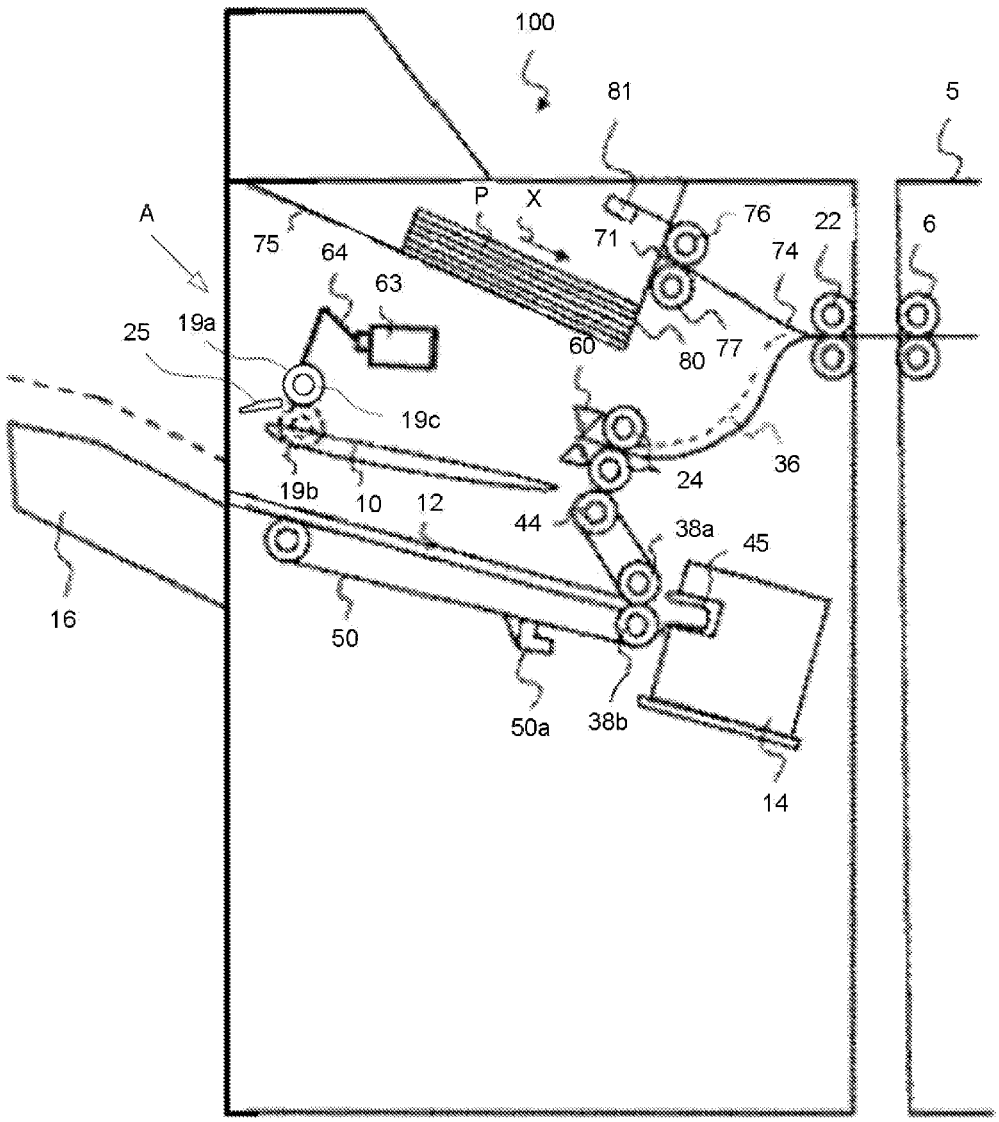
FIG. 1 is a schematic diagram of an image forming apparatus provided with a paper conveyance apparatus according to a first embodiment.

FIG. 1 is a schematic diagram of an image forming apparatus provided with a paper conveyance apparatus 100 according to a first embodiment. The paper conveyance apparatus 100 carries out a paper post-processing, which includes stapling, sorting, hole punching, and saddle-stitching. A paper processing apparatus carrying out a stapling processing is described herein.

A fixed tray 75 is arranged on the upper portion of a paper conveyance apparatus 100. The fixed tray 75 is inclined so that the front end of a loaded paper P is higher than the rear end of the paper. A pair of paper discharging rollers 76 and 77 serving as a discharging mechanism for clamping and conveying a paper P is arranged adjoining a paper discharge port 71 of the fixed tray 75. A fixed tray path 74 is arranged between an inlet roller 22 for receiving a paper P from an apparatus at the front end of an image forming apparatus 5 and the paper discharge port 71 to guide the paper P to the paper discharging rollers 76 and 77.

A plurality of tray ribs 80 are arranged below the paper discharge port 71 as a rear end supporter for supporting the rear end of a paper P. The fixed tray 75 and the tray ribs 80 are integrally molded. A sensor 81 is arranged above the paper discharge port 71 to detect the loading limit of the papers P on the fixed tray 75.

As stated above, the fixed tray 75 is arranged in an inclined state so that the front end of a paper P is higher than the rear end of the paper P. Thus, due to the inclination of the fixed tray 75, a paper P conveyed to the fixed tray 75 returns towards the direction indicated by an arrow x, that is, the rear end direction of the sheet. Then the rear end of the paper P is abutted against the tray ribs 80, thereby longitudinally aligning the papers P. Similarly, the papers P discharged from the image forming apparatus 5 are successively discharged to the fixed tray 75 until a given number of papers are loaded, and then the papers are longitudinally aligned.

A standby tray 10 is arranged below the fixed tray 75. A paper path 36 is arranged between the inlet roller 22 and the standby tray 10 to guide a paper P to a pair of paper feed rollers (paper feed section) 24. Further, an outlet sensor 60 is arranged between the paper feed rollers 24 and the standby tray 10. In the present embodiment, the outlet sensor 60 is arranged adjoining the paper feed rollers 24. The outlet sensor 60 detects a paper P conveyed through the paper path 36. The paper feed rollers 24 convey a paper P while clamping the paper P. A processing tray 12 is arranged below the standby tray 10 for loading the papers P falling from the standby tray 10, that is, from the position between moving tray components 10*a* and 10*b* (See FIG. 2, discussed further below). A roller pair, consisting of a drive roller 19*a* and a driven roller 19*b* in contact with each other under a specified pressure, is located at the downstream side of the paper feed rollers 24, and conveys the paper P conveyed by the paper feed rollers 24. The drive roller 19*a* and the driven roller 19*b* are made from, for example, rubber.

The processing tray 12 aligns and supports loaded papers P during a paper stapling process carried out by a stapler 14. In this embodiment, the stapler 14 serves as a processing mechanism carrying out a paper post-processing. The processing tray 12 is inclined downwards facing the stapler 14, and is provided with a pair of alignment rollers 38*a* and 38*b* which align the papers P falling from the standby tray 10 in a longitudinal direction, that is, a conveyance direction. The alignment rollers 38*a* and 38*b*, which are arranged close to the stapler 14, additionally function as bundle conveyance rollers which clamp a stapled paper bundle and take out the stapled paper bundle from the stapler 14.

Further, when a paper P falls into the processing tray 12 from the standby tray 10, a paddle 44 loaded on the processing tray 12 is arranged at the position where the rear end of the paper P falls. The paddle 44 can be rotated to align the top papers P in a longitudinal direction. The paddle 44 has elasticity and is made from, for example, rubber.

A stopper 45 which is abutted against the rear end of a paper P to regulate the position of the rear end is arranged at the end part of the processing tray 12 at the side of the stapler 14. A conveyance belt 50 is arranged substantially in the center of the processing tray 12. The conveyance belt 50 conveys a paper bundle which is stapled and taken out from the stapler 14 by the alignment rollers 38*a* and 38*b* to a first paper discharging tray (discharging section) 16. A conveyance claw 50*a* is arranged on the conveyance belt 50 to hook the rear end of the paper bundle.

The standby tray 10 is capable of making a paper P fall into the processing tray 12. On the other hand, the standby tray 10 is also capable of conveying a paper P needing no stapling to the direction of the first paper discharging tray 16. The conveyance of a paper P to the first paper discharging tray 16 is realized through the roller pair consisting of, for example, the drive roller 19*a* and the driven roller 19*b*, by contacting with the paper P on the standby tray 10.

The drive roller 19*a* is driven to rotate by a rotation solenoid 63 through an arm 64 and is also rotationally driven by a conveyance motor (not shown) which is connected with a first roller shaft 19*d* which can rotationally support the drive roller 19*a*. When abutted against the drive roller 19*a*, the driven roller 19*b* is rotated through the rotation of the drive roller 19*a*. A nip is formed between the driven roller 19*b* and the drive roller 19*a* when the driven roller 19*b* is abutted against the drive roller 19*a*.

A corrugation component 25, which will be described later, is arranged above position where a paper P is discharged through the roller pair consisting of, for example, the drive roller 19*a* and the driven roller 19*b*.

Figure 2:
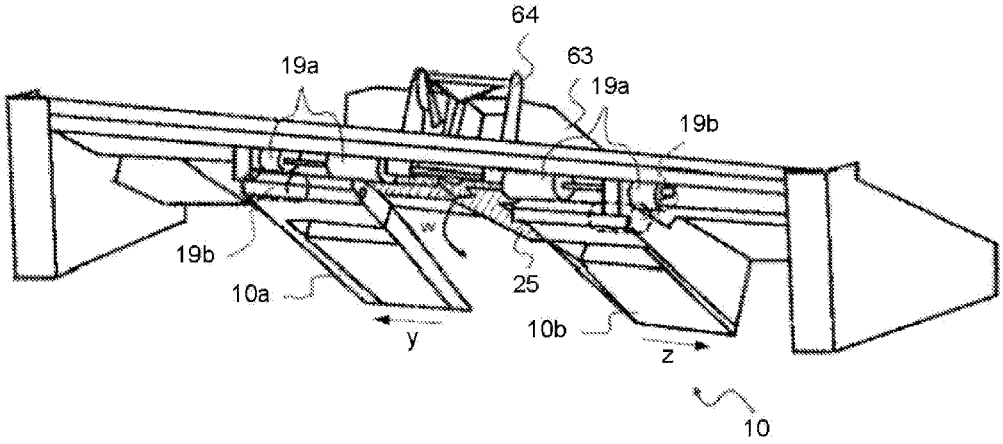
FIG. 2 is a perspective view illustrating a portion of the paper conveyance apparatus shown in FIG. 1.

FIG. 2 is a perspective view of the standby tray 10. The standby tray 10 is inclined so that the front end of a paper P is higher than the rear end of the paper. The standby tray 10 consists of a pair of tray components 10*a* and 10*b*, which slide in the width direction of a paper P, and is configured to receive a paper P and support two sides of the paper P. The standby tray 10 is moved by a standby tray motor (not shown) to slide. The tray component 10*a* slides in the direction indicated by an arrow y and a direction reverse to the direction indicated by an arrow y. The tray component 10*b* slides in the direction indicated by an arrow z and a direction reverse to the direction indicated by an arrow z. The driven roller 19*b* arranged on the standby tray 10 is moved to slide through the slide movement of the standby tray 10.

A series of flows of the papers P in the paper conveyance apparatus 100 are described below. There are three conveyance paths for papers P: a first conveyance path through which a paper P is discharged to the fixed tray 75 without being stapled; a second conveyance path through which a paper P is discharged to the paper discharging tray 16 without being stapled; and a third conveyance path through which a paper P is stapled and discharged from the processing tray 12 to the paper discharging tray 16.

The first conveyance path is described first. In a case where a paper is discharged to the fixed tray 75 without being stapled, a paper P discharged from the paper feed roller 6 of the image forming apparatus 5 is received by the inlet roller 22 and conveyed to the paper discharging rollers 76 and 77 through the tray path 74 and then discharged to the fixed tray 75. The papers P discharged from the image forming apparatus 5 are successively discharged to the fixed tray 75 until a given number of papers are loaded, and then the papers are longitudinally aligned.

The second conveyance path is now described. In a case where a paper P is discharged to the first paper discharging tray 16 without being stapled, for example, the paper discharging tray 16 slides to the position indicated by the dotted line shown in FIG. 1 in advance. When no stapling processing is needed, the paper P conveyed to the inlet roller 22 is conveyed from the inlet roller 22 to the paper feed roller 24 through the paper path 36 and is fed to the standby tray 10 by the paper feed roller 24. Sequentially, the paper P is conveyed on the standby tray 10 by the drive roller 19*a* and the driven roller 19*b* and discharged to the paper discharging tray 16.

The third conveyance path is now described. When a paper P is subjected to a stapling processing, the tray components 10*a* and 10*b* of the standby tray 10 slide so that the paper P can be supported. The paper P discharged from the image forming apparatus 5 and fed by the paper feed roller 24 is, for example, loaded on the standby tray 10 to wait for the completion of the stapling processing of the preceding paper P on the processing tray 12. A plurality of papers P are loaded on the standby tray 10 during the period of the processing carried out in the processing tray 12.

If the preceding paper P on the processing tray 12 is discharged to the paper discharging tray 16 and a preceding stapling processing carried out in the processing tray 12 is completed, the tray component 10*a* shown in FIG. 2 slides in the direction indicated by the arrow y, and the tray component 10*b* slides in the direction indicated by the arrow z. Then, the paper P loaded on the standby tray 10 falls into the processing tray 12. After the stapling processing, the conveyance belt 50 is driven to hook the rear end of a stapled paper bundle T with the conveyance claw 50*a* to convey the paper bundle T to the paper discharging tray 16.

When conveying a paper P of a long size is to be conveyed to the standby tray 10, the paper P can be conveyed to the standby tray 10 through the conveyance based on the paper feed roller 24 even if the drive roller 19*a* is separated from the driven roller 19*b*. The driven roller 19*b*, if separated from the drive roller 19*a*, has no conveyance force to convey a paper P. However, a paper P of a long size such as FOLIO, due to its sufficient length, can be conveyed to the standby tray 10 by the paper feed roller 24 at the upstream side of the driven roller 19*b*.

In this case, as the paper P of a long size such as FOLIO is long in longitudinal direction, the paper P can be prevented from hanging down even if the drive roller 19*a* is separated from the driven roller 19*b* or the paper is corrugated by the corrugation component 25, and the paper contacts the paper discharging tray 16. Even in the conveyance of a paper P in the aforementioned third conveyance path, the front end of the paper P contacts the paper discharging tray 16 when the paper P is waiting on the standby tray 10.

Figure 3:
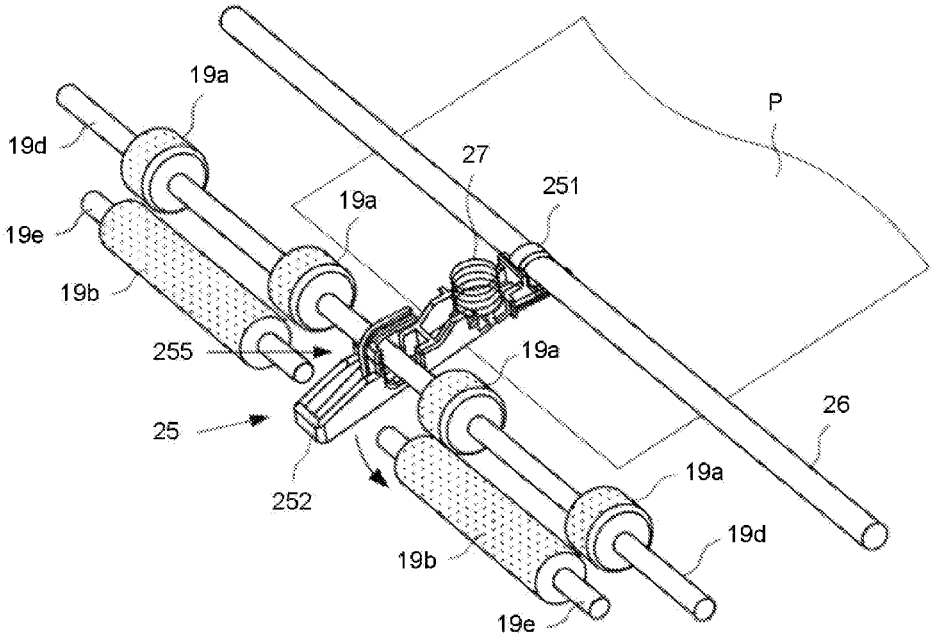
FIG. 3 is a perspective view illustrating the portion of the paper conveyance apparatus observed from the direction indicated by an arrow A shown in FIG. 1.

FIG. 3 is a perspective view illustrating a portion of the paper conveyance apparatus 100 observed from the direction indicated by an arrow A shown in FIG. 1. FIG. 3 illustrates the final stage of the aforementioned second conveyance path through which the paper P is discharged to the first paper discharging tray 16 without being stapled. In order to illustrate the relation among the first roller shaft, the second roller shaft and the corrugation component 25, the tray components 10*a* and 10*b* are not shown in FIG. 3.

A plurality of (four, in the example shown in FIG. 3) roller pairs are arranged at given intervals in a direction orthogonal to the conveyance direction of papers. The interval and the number of the roller pairs can be properly changed according to the maximum or minimum width of the papers processed by the image forming apparatus. The roller pair consists of the drive roller 19*a* and the driven roller 19*b* which are contacted with each other under a specified pressure.

The drive roller 19*a* rotates around the first roller shaft 19*d*, arranged orthogonal to the conveyance direction of papers, as a center. The driven roller 19*b* rotates around the second roller shaft 19*e*, arranged parallel to the first roller shaft 19*d*, as a center. Further, the drive roller 19*a* and the driven roller 19*b* are arranged in such a manner that the drive roller 19*a* is above the driven roller 19*b* and opposite to the driven roller 19*b* in the vertical direction.

The first roller shaft 19*d* may be, for example, a metal shaft. Further, the first roller shaft 19*d* rotates bi-directionally using a motor (not shown) as a drive source. A plurality of drive rollers 19*a* are arranged on the first roller shaft 19*d*. Thus, the plurality of drive rollers 19*a* integrated with the first roller shaft 19*d* are rotated as the first roller shaft 19*d* is rotated.

Each of the driven rollers 19*b* is supported to rotate separately around the second roller shaft 19*e* as a center. The drive roller 19*a* is pressed to each of the driven rollers 19*b* by a roller pressing component, which may be, for example, a spring component (not shown).

Moreover, in addition to the plurality of roller pairs, the paper discharging section is further provided with the corrugation component 25. The corrugation component 25 is an arm-shaped component which corrugates the paper discharged by the roller pair. A member 251 at one end of the corrugation component 25 can rotationally support a shaft 26. The corrugation component 25 is orthogonal to the shaft 26 and is supported in such a state that the corrugation component 25 extends downstream in the paper conveyance direction.

Figure 4:
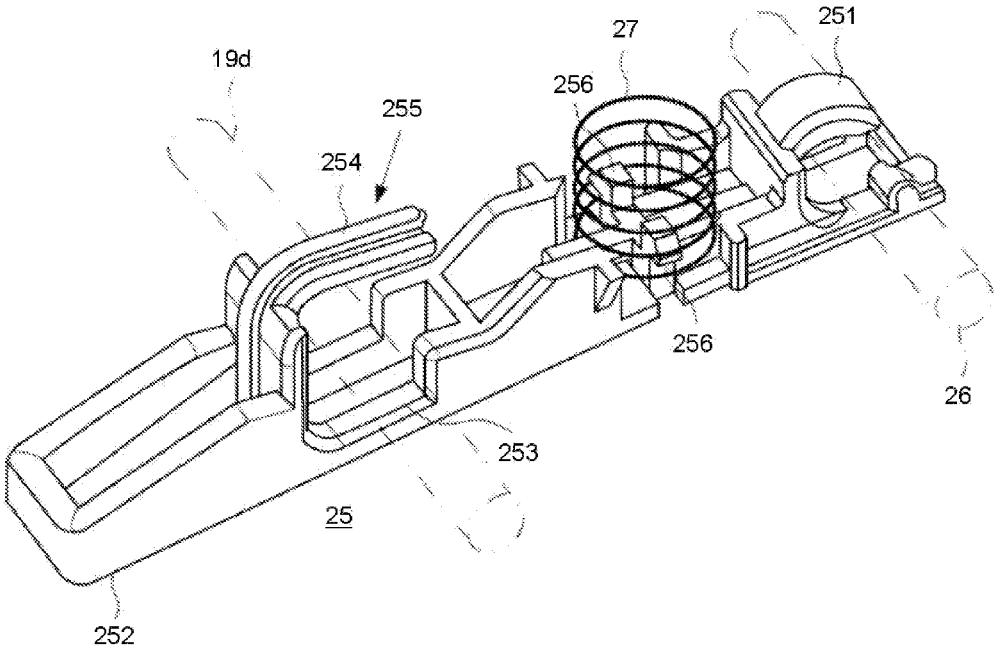
FIG. 4 is a perspective view illustrating the portion of the paper conveyance apparatus shown in FIG. 1.

As shown in FIG. 4, a corrugation section 252 for pressing a paper P is formed on the lower side of the other end of the corrugation component 25. An engaging section 255 is formed by integrating an engaging concave section 253 with an engaging piece 254 at a position opposite to the engaging concave section 253. The engaging section 255 is arranged on the corrugation component 25 between the corrugation section 252 and the member 251. The engaging section 255 is engaged around the first roller shaft 19*d*. The engaging concave section 253 is engaged with the first roller shaft 19*d* with a play of distance L therebetween (refer to FIG. 5). Therefore, the engaging concave section 253 can move a little in a direction orthogonal to the first roller shaft 19*d*.

Herein, in the paper conveyance apparatus according to the present embodiment, a center reference method in which a paper is conveyed by taking the center of the width of the paper as a reference is adopted as a paper conveyance method. In the use of the center reference method, even if the width of papers conveyed in the paper conveyance path is changed, the centers of the width of the papers pass a common center reference position. Thus, in the direction of a rotation shaft of the roller pair orthogonal to the paper conveyance direction, the two inner drive rollers 19*a* are arranged at positions the same distance away from the center reference position. The two outer drive rollers 19*a* are also arranged at positions the same distance away from the center reference position.

A spring 27 is arranged between the member 251 and the engaging section 255 of the corrugation component 25 as an elastic component. One end of the spring 27 is engaged with a locking section 256 which is integrally formed on the corrugation component 25. The other end of the spring 27 is engaged with, for example, a frame 28 in the main body of the paper conveyance apparatus 100 (refer to FIG. 5). The elastic component may also be a cushion material or the like.

Figure 5:
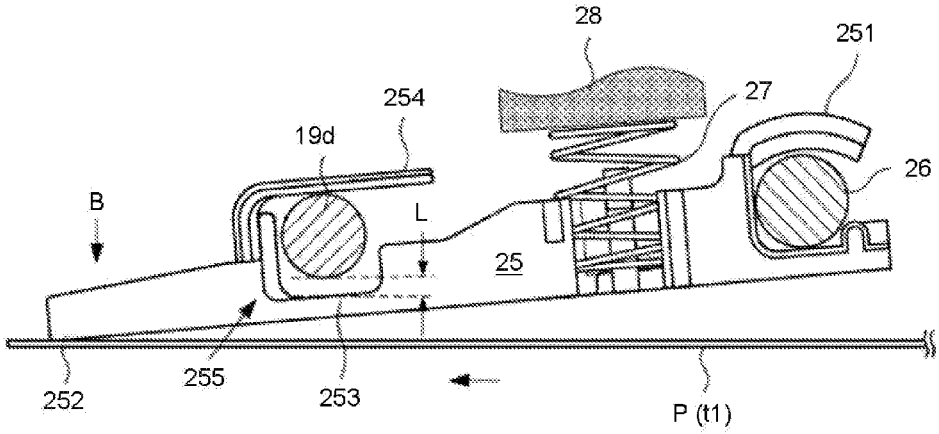
FIGS. 5 and 6 are each side views of the portion of the paper conveyance apparatus shown in FIG. 1.

Thus, the corrugation component 25 is pressed by taking the member 251 as the center in the direction indicated by the arrow B shown in FIG. 5 through the elastic force of the spring 27. The range of the pressing distance of the corrugation component is equivalent to the distance L of the play between the first roller shaft 19*d* and the engaging section 255 as shown in FIG. 5.

Figure 6:
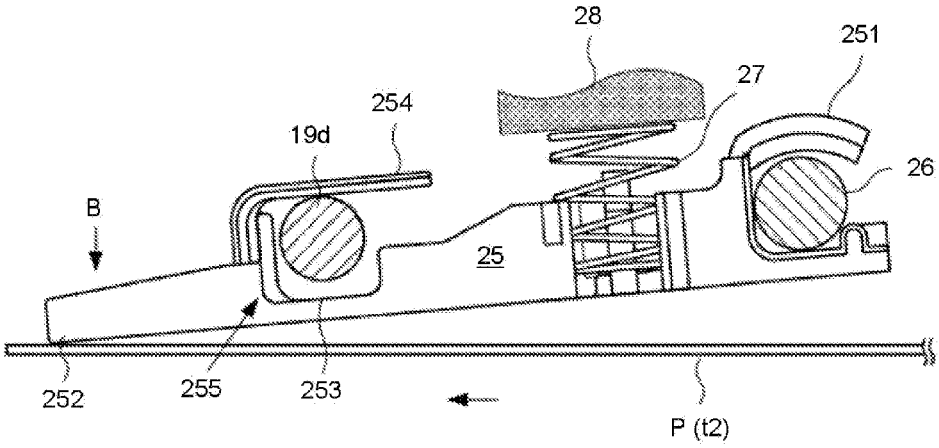

Operations of the corrugation component 25 are described herein with reference to FIG. 5 and FIG. 6.

The thickness of the paper P used in FIG. 5 is t1 and that of the paper P used in FIG. 6 is t2. In this example, the thicknesses t1 and t2 meet the following condition: $t1<t2$. Further, the papers used in FIG. 5 and FIG. 6 are made from the same material.

First, the paper P having a thickness t1 used in FIG. 5 is discharged through the roller pair. One part of the paper P is abutted against the corrugation section 252 under the elastic force of the spring 27 during the discharging process. The part of the paper P abutted against the corrugation section 252 is pressed to be corrugated. FIG. 7A illustrates a state in which the paper P having a thickness t1 is corrugated. At this time, the angle of the corrugation shown in FIG. 7A is set to be $\theta 1$.

Similarly, the paper P having a thickness t2 used in FIG. 6 is discharged through the roller pair. One part of the paper Pis abutted against the corrugation section 252 under the elastic force of the spring 27 during the discharging process. The part of the paper P abutted against the corrugation section 252 is pressed to be corrugated. FIG. 7B illustrates a state in which the paper P having a thickness t2 is corrugated. The angle of the corrugation shown in FIG. 7B is set to be $\theta 2$ at this time.

As noted above, the papers P having a thickness t1 and a thickness t2 are made from the same material. Accordingly, the paper P having the thickness t2 has stronger resistance to the elastic force of the spring 27. As the thickness t2 is greater than the thickness t1, the angles of the corrugations meet the following relationship: $\theta 1>\theta 2$. As a result, the paper P having a thickness t1 is greatly corrugated.

In this way, a thin paper P can be corrugated greatly. Thus, an adjustment can be made to corrugate a paper properly corresponding to the thickness of the paper P.

The thickness of a paper is taken into consideration in the description above. Moreover, papers made from different materials can be corrugated corresponding to materials thereof under the effect of the elastic component.

FIG. 8 illustrates a comparison on paper conveying loads for the conventional corrugation component and the corrugation component described in the present embodiment. According to the results of five times of measurement, the average conveying load of the conventional corrugation component is 168 gf and that of the corrugation component described in the present embodiment is 115 gf.

From the results illustrated in FIG. 8, it can be concluded that the corrugation component 25 described in the present embodiment is capable of reducing conveying load. Thus, a smooth paper conveyance can be achieved even in the use of a corrugation component.

Papers can be conveyed smoothly in the present embodiment. Further, an elastic component for applying elasticity in the direction of a paper is arranged on the corrugation component which corrugates the paper. Thus, a paper can be properly corrugated without using a sensor for detecting the thickness of a paper.

A Second Embodiment

Figure 9:
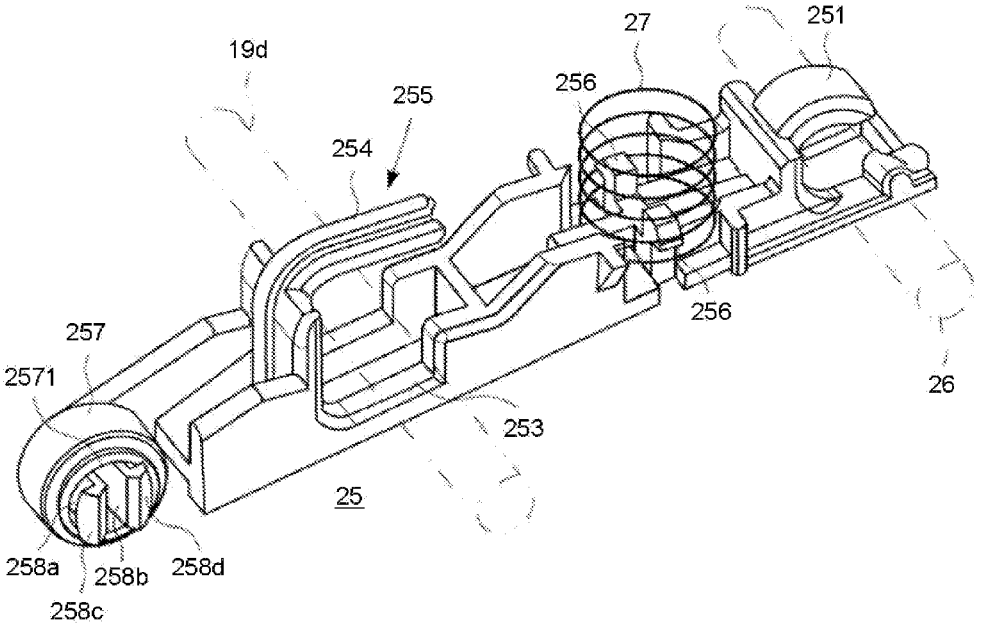
FIG. 9 is a perspective view of a portion of a paper conveyance apparatus, according to a second embodiment.

FIG. 9 is a perspective view of the corrugation component 25 illustrating a second embodiment of the paper conveyance apparatus. The corrugation component 25 described in the first embodiment slides with respect to a paper P while applying a pressing force to the paper P, thereby corrugating the paper P using the corrugation section 252. However, the paper may not be corrugated smoothly if the paper P is thick or the smoothness of the surface of the paper P is poor.

Thus, in the second embodiment, a corrugation roller 257 is arranged at a position equivalent to the position of the corrugation section 252 described in the first embodiment.

A support hole 2571 is formed on the corrugation roller 257. Two support shafts 258*a* and 258*b*, which may be integrally formed on the corrugation component 25, are inserted into the support hole 2571 to rotationally support the support hole 2571. Locking claws 258*c* and 258*d*, each facing opposite directions, are formed on the front ends of the support shafts 258*a* and 258*b*. The locking claws 258*c* and 258*d* have elasticity. The corrugation roller 257 is pushed against the locking claws 258*c* and 258*d* to close the two locking claws to each other. Consequently the corrugation roller 257 is positioned around the support shafts 258*a* and 258*b*, and then the locking claws 258*c* and 258*d* returns to the original position. Thereby, the corrugation roller 257 is rotationally supported.

The corrugation roller 257 corrugates the paper P while rotating on the paper P. The friction between the paper P and the corrugation component 25 due to the elasticity of the spring 27 can be reduced.

In the presently described second embodiment, a paper can be conveyed smoothly even if the friction between the paper P and the corrugation component is increased as the paper P is thick or the smoothness of the surface of the paper is poor.

A Third Embodiment

Figure 10:
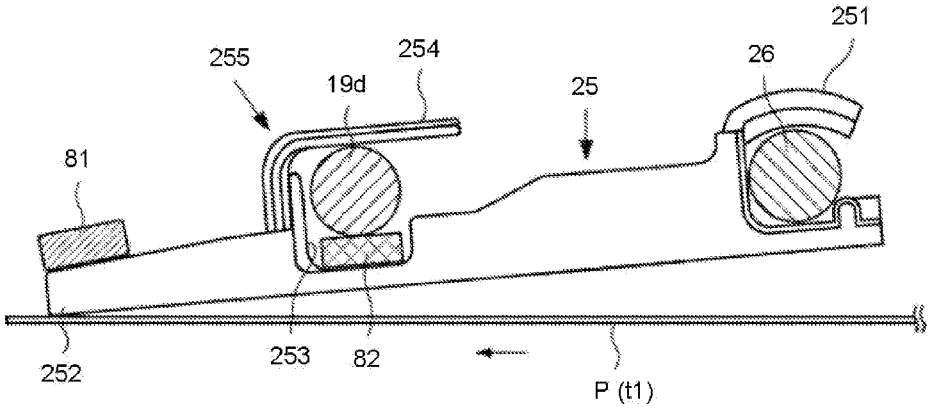
FIG. 10 is a side view of a portion of a paper conveyance apparatus, according to a third embodiment.

FIG. 10 is a side view of a portion of a third embodiment of the corrugation component 25.

In the present embodiment, instead of the spring 27 described in the first embodiment, a weight 81 is arranged on the corrugation component 25. The weight 81 is arranged on a corrugation component 25 far away from the shaft 26 which is rotationally supported. Moreover, a cushion material 82 is arranged between the engaging concave section 253 and the first roller shaft 19*d* between which a play is set. The cushion material 82 is arranged to prevent a mechanical noise caused by the contact of the engaging concave section 253 with the first roller shaft 19*d* during the conveyance process of a paper P. The corrugation component 25 is pressed towards the direction of the paper P by the weight 81.

Figure 11:
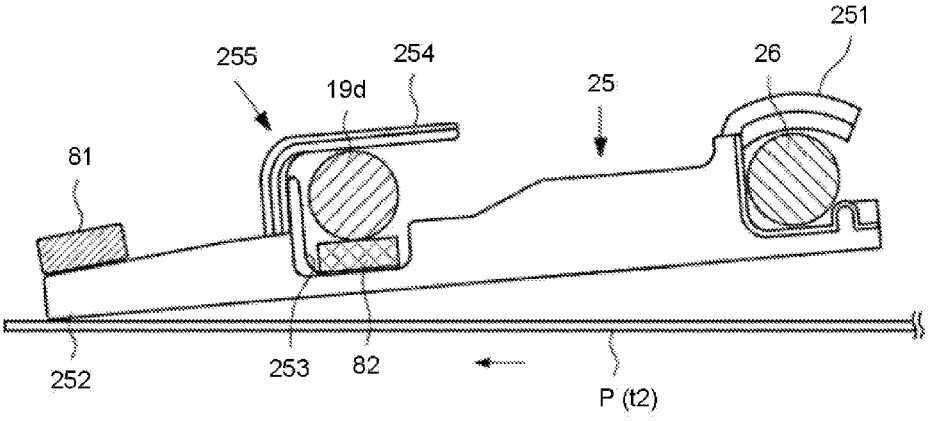
FIG. 11 is a side view of the portion of the paper conveyance apparatus according to the third embodiment.

The effect of the third embodiment is described herein with reference to FIG. 10 and FIG. 11. The present embodiment is also described by taking the papers P used in FIG. 10 and FIG. 11 which are made from the same material but have different thicknesses as an example. The thickness of the paper P used in FIG. 10 is set to be t1 and that of the paper P used in FIG. 11 is set to be t2. The thicknesses t1 and t2 meet the following relationship: $t1<t2$.

Thus, the thickness t1 of the paper P used in FIG. 10 is smaller than the thickness t2 of the paper P used in FIG. 11, and the corrugations generated by the weight 81 is as that shown in FIG. 7A. Similarly, the thickness t2 of the paper P used in FIG. 11 is greater than the thickness t1 of the paper P used in FIG. 10, and the corrugations generated by the weight 81 is as that shown in FIG. 7B.

Thus, with the use of the weight 81, a thin paper P can be corrugated greatly while a thick paper P can be corrugated slightly. Further, the corrugation section 252 abutted against a paper P may also be the corrugation roller 257 described in the second embodiment.

In this embodiment, a paper can be properly corrugated corresponding to the paper by pressing a corrugation component for corrugating a paper towards the direction of the paper.

A Fourth Embodiment

Figure 12:
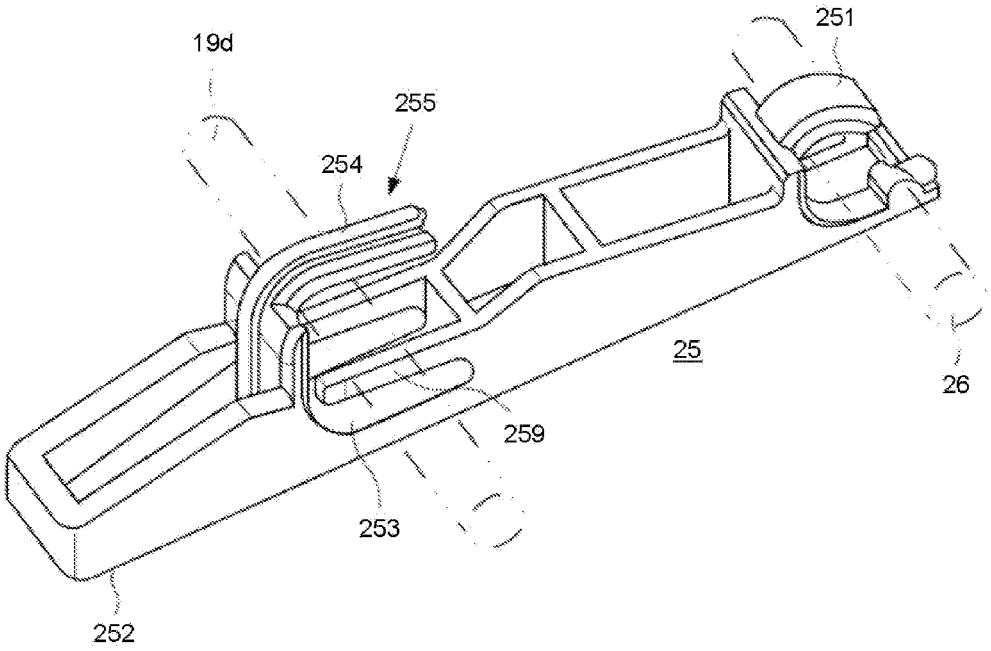
FIG. 12 is a perspective view of a portion of a paper conveyance apparatus according to a fourth embodiment.

FIG. 12 is a perspective view of the corrugating component 25 according to a fourth embodiment. In the fourth embodiment, the spring 27 or the weight 81 described in the embodiments above is replaced by an elastic piece 259.

The elastic piece 259 is integrally formed on the corrugation component 25 in the opened part of the engaging concave section 253 opposite to the engaging piece 254. The elastic piece 259 has elasticity in a direction orthogonal to the first roller shaft 19*d*. The first roller shaft 19*d* is arranged between the engaging piece 254 and the elastic piece 259. The corrugation component 25 rotates around the shaft 26 as the center according to the thickness of a paper P.

Figure 13:
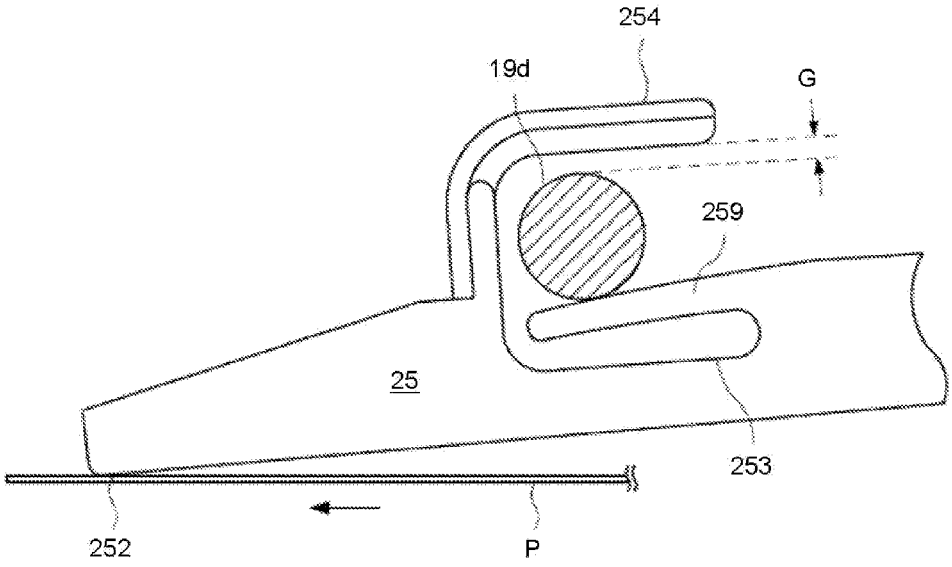
FIG. 13 is a side view of the portion of the paper conveyance apparatus according to the fourth embodiment.

The engaging piece 254 is engaged with the first roller shaft 19*d* with a play of distance G therebetween (refer to FIG. 13). Therefore, the engaging concave section 253 can move a little in a direction orthogonal to the first roller shaft 19*d*. The range of the pressing distance of the corrugation component is equivalent to the distance G of the play between the first roller shaft 19*d* and the engaging piece 254 as shown in FIG. 13. That is, the corrugation component 25 rotates when the thickness of a paper P is increased so as to adjust the extent of the corrugation. In the case of a thin paper P, the corrugation component 25 resists to the elasticity of the elastic piece 259 to corrugates the thin paper P to a lesser extent. In the case of a thick paper P, the corrugation component 25 restricts the extent of corrugation based on the elastic piece 259 and corrugates the thick paper P.

The papers, which are made from the same material with respective thicknesses t1 and t2 having the relationship $t1<t2$, are also taken as an example in the present embodiment. When the paper P having the thickness t1 passes through the corrugation section 252, the corrugation component 25 does not rotate, and a corrugation generated on the paper P is in a state equivalent to the state shown in FIG. 7A. When the paper P having the thickness t2 passes through the corrugation section 252, the corrugation component 25 rotates. In this way, the generated corrugation is in a state equivalent to the state shown in FIG. 7B.

Thus, with elastic piece 259, a thin paper P can be corrugated greatly and a thick paper P can be corrugated slightly, thereby a paper can be properly corrugated.

A Fifth Embodiment

Figures 14, 15:
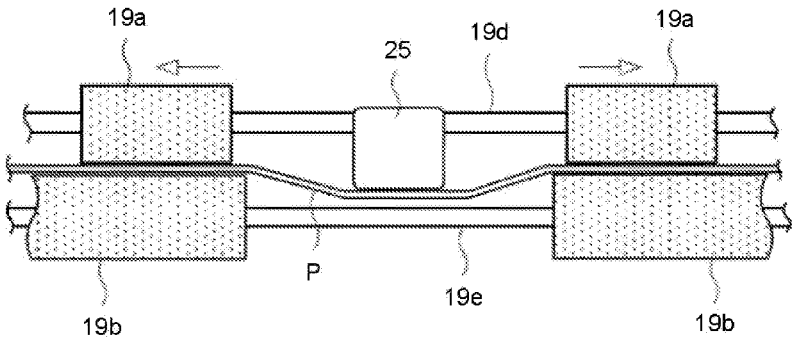
FIG. 14 is a front view of a portion of a paper conveyance apparatus according to a fifth embodiment.
FIG. 15 is a diagram illustrating an effect of the fifth embodiment.

FIG. 14 is a side view of the corrugating component 25 according to a fifth embodiment.

In the embodiments described, a paper P is corrugated by the corrugation component 25. Moreover, the widths of the tray components 10*a* and 10*b* of the standby tray 10 are adjusted according to the size of a paper P while positions of the drive roller 19*a* and the driven roller 19*b* are adjusted.

The distance between each roller pair (drive roller 19*a* and corresponding driven roller 19*b*) should be as wide as possible according to the size of the paper P without narrowing the conveyance nip between the drive roller 19*a* and the driven roller 19*b*. The adjustment of the distance between the roller pairs is indicated by arrows in FIG. 14.

Residual paper conveyance forces obtained when the width of a standby tray is changed in the conventional corrugation component and in the corrugation component described in the present embodiment are compared in FIG. 15. The residual conveyance force represents the residual conveyance force obtained when temperature drops and the friction coefficient between the drive roller 19*a* and the driven roller 19*b* made from rubber is reduced.

FIG. 15 shows measurement results on residual conveyance forces obtained when the clamping width of a paper P based on the tray components 10*a* and 10*b* is changed and when a condition for the corrugation component is changed. Clamping widths of 165 mm and 177.4 mm are taken as examples of changed clamping widths of a paper P. The change in a condition for the corrugation component refers to: (1) the use of the conventional corrugation component, (2) the use of the corrugation component described in the present embodiment and (3) no use of a corrugation component.

As shown in FIG. 15, residual conveyance force was measured five times for each combination of the clamping widths and corrugation component. In the case where the width of the tray components 10*a* and 10*b* of the standby tray 10 is 165 mm, the average residual conveyance force is 32 gf in the use of the conventional corrugation component, 108 gf in the use of the corrugation component described herein and 500 gf when no corrugation component is used. Similarly, in the case where the width of the tray components 10*a* and 10*b* is 177.4 mm, the average residual conveyance force is 159 gf in the use of the conventional corrugation component, 220 gf in the use of the corrugation component described herein and 500 gf when no corrugation component is used.

When the corrugation component 25 described in the present embodiment is used, conveying load is reduced, as shown in FIG. 8, while residual conveyance force is increased, as shown in FIG. 15. Thus, even in the use of a corrugation component, a paper can be conveyed smoothly while the residual conveyance force required for conveyance can be guaranteed.

Papers can be conveyed smoothly even in the use of a corrugation component in the present embodiment. Moreover, by adjusting the gap between the drive roller and the driven roller matching with the size of a paper, residual conveyance force is obtained without narrowing the conveyance nip.

In the aforementioned embodiments, an example is described in which only one corrugation component is arranged in the center of the standby tray 10, however, the present invention is not limited to this, a plurality of corrugation components may be arranged. Further, the conveyance of a paper is based on a center reference; however, a paper may also be conveyed even if the paper deviates in a direction orthogonal to the paper conveyance direction. In this case, it is preferred that a plurality of corrugation components are arranged corresponding to the size of the paper.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A paper conveyance apparatus, comprising:

a roller pair including a drive roller and a driven roller configured to discharge a paper from a main body of an image forming apparatus;

a corrugation component configured to abut against the paper discharged by the roller pair to corrugate the paper as the paper is discharged; and an elastic component configured to push the corrugation component against the discharged paper, wherein the drive roller rotates about a first shaft, a first end of the corrugation component is rotationally supported by a second shaft, and a second end of the corrugation component is engaged with the first shaft with a distance between the second end and the first shaft to allow for relative movement between the second end and the first shaft.

2. The paper conveyance apparatus according to claim 1, wherein the corrugation component includes a roller that abuts against the paper.

3. The paper conveyance apparatus according to claim 1, wherein the corrugation component corrugates the paper at the downstream side of the roller pair in a paper conveyance direction.

4. The paper conveyance apparatus according to claim 1, wherein:

the roller pair includes a first roller pair and a second roller pair, each roller pair including a drive roller and a driven roller, and each roller pair being arranged on a shaft on opposite sides of a center point of the shaft.

5. The paper conveyance apparatus according to claim 4, wherein a distance between the first roller pair and the second roller pair is adjustable according to size of the paper.

6. A paper conveyance apparatus, comprising:

a roller pair including a drive roller and a driven roller configured to discharge a paper from a main body of an image forming apparatus;

a corrugation component configured to abut against the paper discharged by the roller pair to corrugate the paper; and a weight configured to push the corrugation component against the discharged paper, wherein the drive roller rotates about a first shaft, a first end of the corrugation component is rotationally supported by a second shaft, and a second end of the corrugation component is engaged with the first shaft, with a cushion material between the second end and the first shaft.

7. The paper conveyance apparatus according to claim 6, wherein the corrugation component includes a roller that abuts against the paper.

8. The paper conveyance apparatus according to claim 6, wherein the corrugation component corrugates the paper at the downstream side of the roller pair in a paper conveyance direction.

9. The paper conveyance apparatus according to claim 6, wherein:

the roller pair includes a first roller pair and a second roller pair, each roller pair including a drive roller and a driven roller, and the first roller pair and the second roller pair being arranged on a shaft on opposite sides of a center point of the shaft.

10. The paper conveyance apparatus according to claim 9, wherein a distance between the first roller pair and the second roller pair is adjustable according to a size of the paper.

11. A paper conveyance apparatus, comprising:

a roller pair including a drive roller and a driven roller configured to discharge a paper from a main body of an image forming apparatus;

a corrugation component configured to abut against the paper discharged by the roller pair to corrugate the paper; and an elastic piece formed on the corrugation component and configured to elastically deform thereby pushing the corrugation component against the discharged paper, wherein the drive roller rotates about a first shaft, a first end of the corrugation component is rotationally supported by a second shaft, and a second end of the corrugation component is engaged with the first shaft, with a distance between the second end and the first shaft allowing for relative movement between the second end and the first shaft.

12. The paper conveyance apparatus according to claim 11, wherein the corrugation component includes a roller that abuts against the paper.

13. The paper conveyance apparatus according to claim 11, wherein:

the roller pair includes a first roller pair and a second roller pair, each roller pair including a drive roller and a driven roller, and each roller pair being arranged on a shaft on opposite sides of a center point of the shaft.

14. The paper conveyance apparatus according to claim 13, wherein a distance between the first roller pair and the second roller pair is adjustable according to a size of the paper.

* * * * *